US008215950B2

(12) United States Patent
Singh et al.

(10) Patent No.: US 8,215,950 B2
(45) Date of Patent: Jul. 10, 2012

(54) LOW EMISSION AND FLASHBACK RESISTANT BURNER TUBE AND APPARATUS

(75) Inventors: Ramanand Singh, Uttar Pradesh (IN); Atul Kumar Vij, Karnataka (IN); Chetan Babu Velkur, Karnataka (IN)

(73) Assignee: Genral Electric Company, Schenectady, NY (US)

( * ) Notice: Subject to any disclaimer, the term of this patent is extended or adjusted under 35 U.S.C. 154(b) by 524 days.

(21) Appl. No.: 12/419,627

(22) Filed: Apr. 7, 2009

(65) Prior Publication Data

US 2010/0255435 A1 Oct. 7, 2010

(51) Int. Cl.
*F23C 7/00* (2006.01)

(52) U.S. Cl. ..... 431/187; 431/181; 431/12; 431/350; 431/351

(58) Field of Classification Search ..... 431/187, 431/181, 328, 12, 326, 350, 351, 352, 354
See application file for complete search history.

(56) References Cited

U.S. PATENT DOCUMENTS 6,019,595 A * 2/2000 Wulfert et al. ..... 431/181
6,238,206 B1 * 5/2001 Cummings et al. ..... 431/181

* cited by examiner

*Primary Examiner* — Alfred Basichas
(74) *Attorney, Agent, or Firm* — Cantor Colburn LLP

(57) ABSTRACT

A burner tube to provide combustible materials to a combustor is provided and includes an annular shroud and a center body, having a cavity defined therein, disposed within the annular shroud to form an annular passage, the annular passage being communicable with a combustion zone of the combustor at an aft portion thereof and including a fore portion in which fuel is injected into the annular passage. The center body includes a surface having a passage defined therein through which air is to be supplied to the annular passage from the cavity at a position, which is downstream from the fuel injection and upstream from the combustion zone. Also provided is a contouring of the centerbody.

11 Claims, 5 Drawing Sheets

LOW EMISSION AND FLASHBACK RESISTANT BURNER TUBE AND APPARATUS

BACKGROUND OF THE INVENTION

The subject matter disclosed herein relates to a burner tube and an apparatus to reduce the emission of nitrogen oxides (NOx) in dry low NOx (DLN) combustors which utilize swirl-stabilized nozzles.

Combustors are components of gas turbine engines in which combustion of fuel and air occurs. The combustion creates thermal energy that is harnessed by the turbine blades for power generation. The combustion process leads to the formation of undesirable by-products, such as nitrogen oxides (NOx), which are exhausted to the atmosphere as pollutants. Recently, efforts have been undertaken to reduce the amount of NOx emissions to make combustors less polluting.

BRIEF DESCRIPTION OF THE INVENTION

According to one aspect of the invention, a burner tube to provide combustible materials to a combustor is provided and includes an annular shroud and a center body, having a cavity defined therein, disposed within the annular shroud to form an annular passage, the annular passage being communicable with a combustion zone of the combustor at an aft portion thereof and including a fore portion in which fuel is injected into the annular passage. The center body includes a surface having a passage defined therein through which air is to be supplied to the annular passage from the cavity at a position, which is downstream from the fuel injection and upstream from the combustion zone.

According to another aspect of the invention, a burner tube to provide combustible materials to a combustor is provided and includes an annular shroud and a center body disposed within the annular shroud to form an annular passage, the annular passage being communicable with a combustion zone of the combustor at an aft portion thereof and having a fore portion in which fuel is injected into the annular passage. The center body includes a surface that protrudes into the annular passage at a position, which is downstream from the fuel injection and upstream from the combustion zone.

According to yet another aspect of the invention, an apparatus is provided and includes a burner tube from which combustible materials are output, and a combustor, in an interior of which a combustion zone is receptive of the combustible materials. The combustor includes a liner wall, and an end plate, the end plate having a first radial portion coupled to a fore end of the liner wall, a second radial portion to which an aft end of the burner tube is coupled and a curved section interposed between the first and second radial portions.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
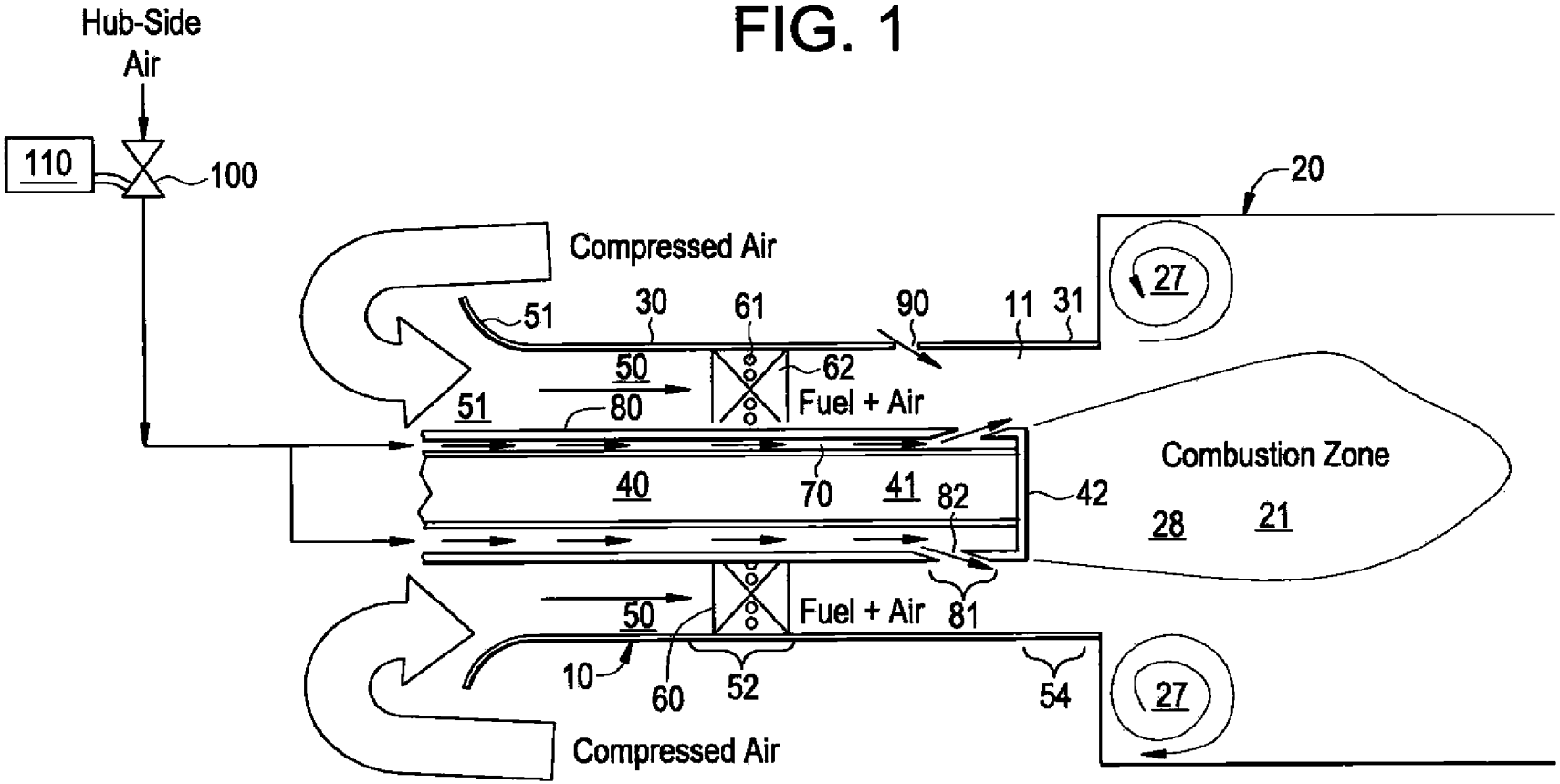
FIG. 1 is a side sectional view of a burner tube having an air injection passage and a combustor in accordance with an embodiment.

With reference to FIG. 1, a burner tube 10 to provide combustible materials to a combustor 20 is provided. The burner tube 10 may include a premixing nozzle that premixes a fuel and air mixture and includes an aft portion 11 where the fuel and air mixture exit the burner tube 10 and enter the combustor 20. That is, air and fuel are premixed in the burner 10 and travel toward the aft portion 11. The combustor 20 is coupled to the aft portion 11 and includes a combustion zone 21 in which a primary recirculation zone 28 is defined. During normal power generating operations, the combustor 20 is receptive of the combustible materials which undergo combustion in the vicinity of the primary recirculation zone 28, which serves as an aerodynamics stabilizing mechanism for the combustion reactions. There may be corner recirculation zones 27 in the vicinity of the end-wall of the combustor 20.

As a result of the combustion, NOx emissions are produced in concentrations that depend on the peak temperature achieved by the products of combustion as well as the residence time of the products at high temperature. As will be described below, however, the production of the NOx emissions can be reduced by, for example, lowering the peak temperature and/or modifying the size of either or both of the primary recirculation zone 28 and the corner recirculation zones 27.

As shown in FIG. 1, the burner tube 10 includes an annular shroud 30 and an extended center body 40. The annular shroud 30 may be generally cylindrical and includes an aft portion 31 which opens up to the combustion zone 21. The center body 40 is shaped in a similar fashion as the annular shroud 30 and is disposed within the annular shroud 30. The center body 40 additionally includes a center body tip 42 at its distal end which is generally positioned slightly forward of the aft portion 31.

The center body 40 and the annular shroud 30 form an annular passage 50. Compressed air enters the annular passage 50 at a bell mouth shaped inlet 51 from a high-pressure plenum that surrounds portions of the burner tube 10. The compressed air then travels aft toward the combustion zone 21. Fuel injectors 60, including centered fuel injector holes 61 and a swirler vane 62, are disposed at a fore portion 52 of the annular passage 50 such that fuel, which is injected into the annular passage 50 by the fuel injectors 60, is premixed with the compressed air to form a fuel-air mixture. The annular passage 50 is communicable with the combustion zone 21 of the combustor 20 at an aft portion 54 of the annular passage 50.

The center body 40 is formed with a cavity 70 defined therein and further includes a surface 80. The surface 80 forms an outer exterior of the center body 40 and has a passage 81 defined therein at a position, which is downstream from that of the fuel injection and upstream from the combustion zone 21. The cavity 70 provides an additional supply of hub-side air that is to be supplied via, e.g., injection, to the annular passage 50 through the passage 81.

Figure 2A:
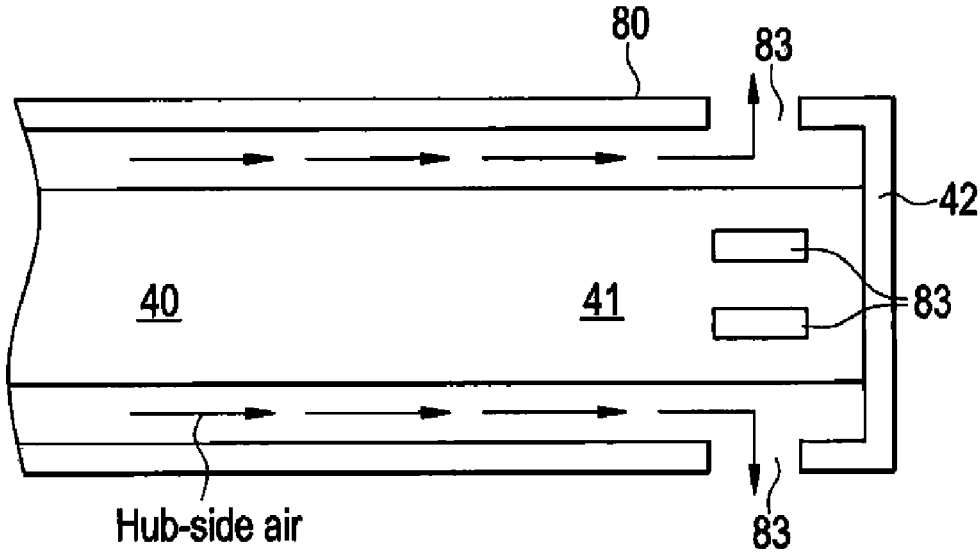
FIGS. 2A and 2B are side sectional views of burner tubes having air injection passages and a combustor in accordance with another embodiment.
Figure 2B:
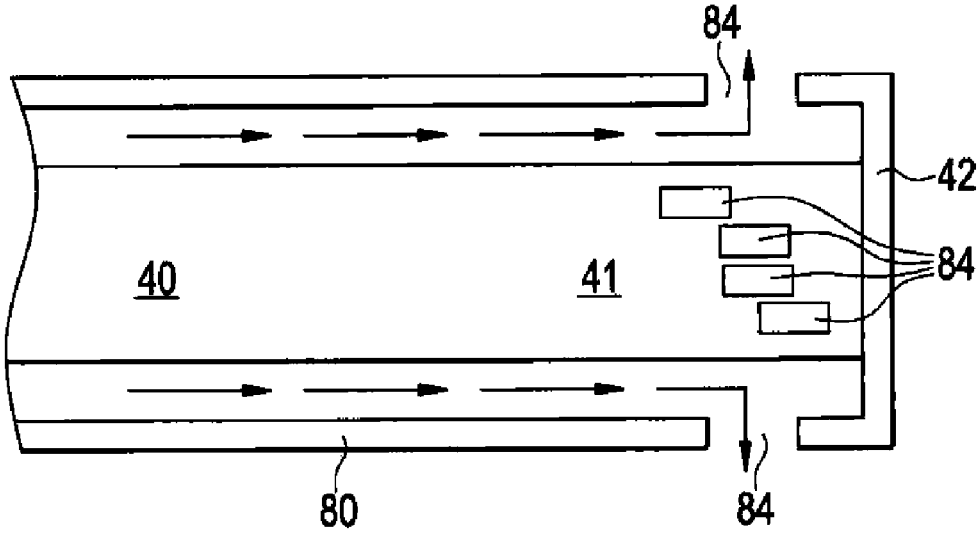

The passage 81 may be formed in various shapes and sizes and may be provided in varied formations. As shown in FIG. 1, the passage 81 may include a concentric annular passage 82 that extends around a circumference of the center body 40. In an alternate example, as shown in FIG. 2A, the passage 81 may be plural in number. Here, passages 83 are arrayed substantially linearly around the center body 40. In yet another alternate example, as shown in FIG. 2B, the passage 81 may again be plural in number with passages 84 arrayed in a staggered formation around the center body 40.

With the hub-side air injected into the annular passage 50, the local fuel-to-air ratio of the combustibles entrained into the recirculation zone is reduced. Accordingly, NOx formation, which is a function of the local fuel-to-air ratio, is also reduced. Further, boundary layer flashback is averted, as the fuel concentration near the center body tip 42 is relatively low due to the injection of the hub-side air.

In numerical simulations, it has been observed that small quantities of hub-side air injection do not appreciably change the flow field in the combustor 20. However, NOx emissions have been reduced by significant amounts. Further, apart from other factors, the amount of NOx formation is strongly dependent on the amount of hub-side air injection through the passage 70.

Shroud-side air may also be injected into the annular passage 50. For this, the annular shroud 30 includes a second passage 90 defined therein through which shroud-side air travels toward the annular passage 50. The second passage 90 may be formed in a similar or different fashion as that of the passage 81.

A quantity of the air to be supplied to the annular passage 50 from the cavity 70 may be automatically controlled in response to current conditions. That is, a valve 100 may be coupled to the cavity 70 and may be controlled by a control device 110, which is coupled thereto, to open or close and to thereby permit an increased quantity of the air to flow into the cavity 70 or to thereby cause a decrease in the quantity of the air. The control device 110 may include a processing unit having memory on which executable instructions are stored, which, when executed cause the processing unit to analyze current conditions and to control the flow through the valve 100 accordingly. The current conditions may be pressures and/or temperatures inside the burner tube 10 and the combustor 20. Thermocouples and/or pressure gauges, coupled to the control device 110, may be disposed at several locations within the burner tube 10 and the combustor 20 such that pressure and/or temperature readings can be transmitted to the processing unit.

Figure 3A:
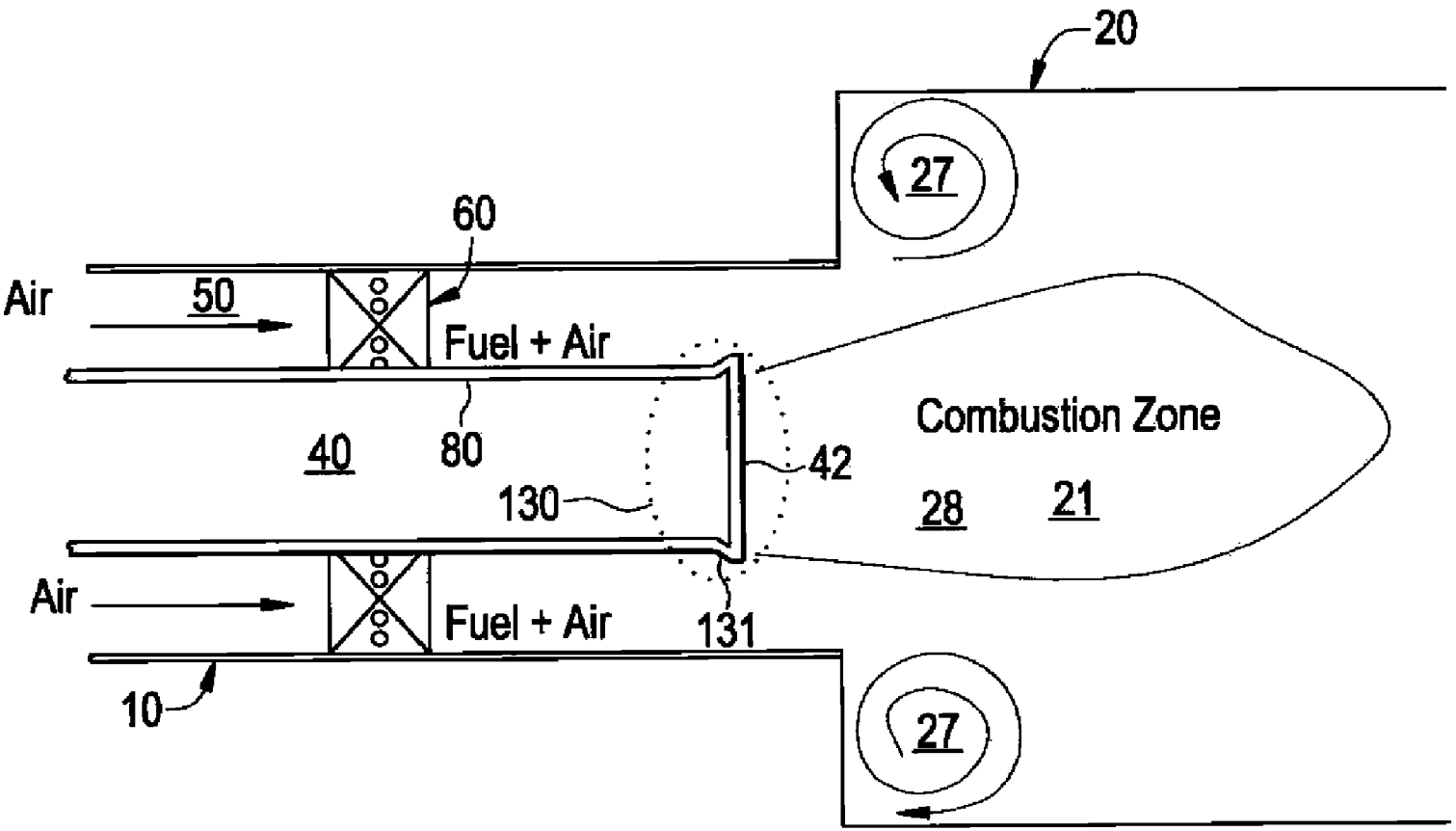
FIGS. 3A and 3B are side sectional views of a burner tube having a contoured center body and a combustor in accordance with another embodiment.
Figure 3B:
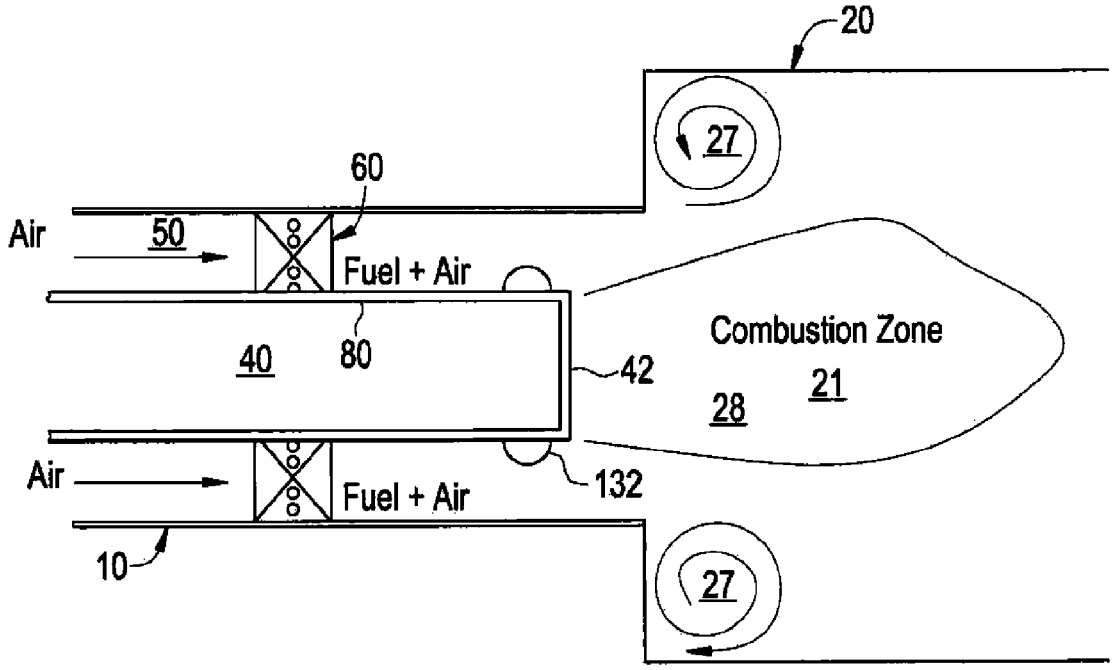

With reference to FIGS. 3A and 3B, the surface 80 may include contouring 130. As shown in FIG. 3A, the contouring 130 may include an outward oriented flare 131 and, as shown in FIG. 3B, the contouring 130 may include a hump 132 disposed on the surface 80. For the outward oriented flare 131, numerical simulations have shown that a size of the primary recirculation zone 28 can be modified alongwith with a significant drop in combustion zone peak temperature. This has been observed to translate to a corresponding reduction in NOx emissions by significant amounts.

Figure 4:
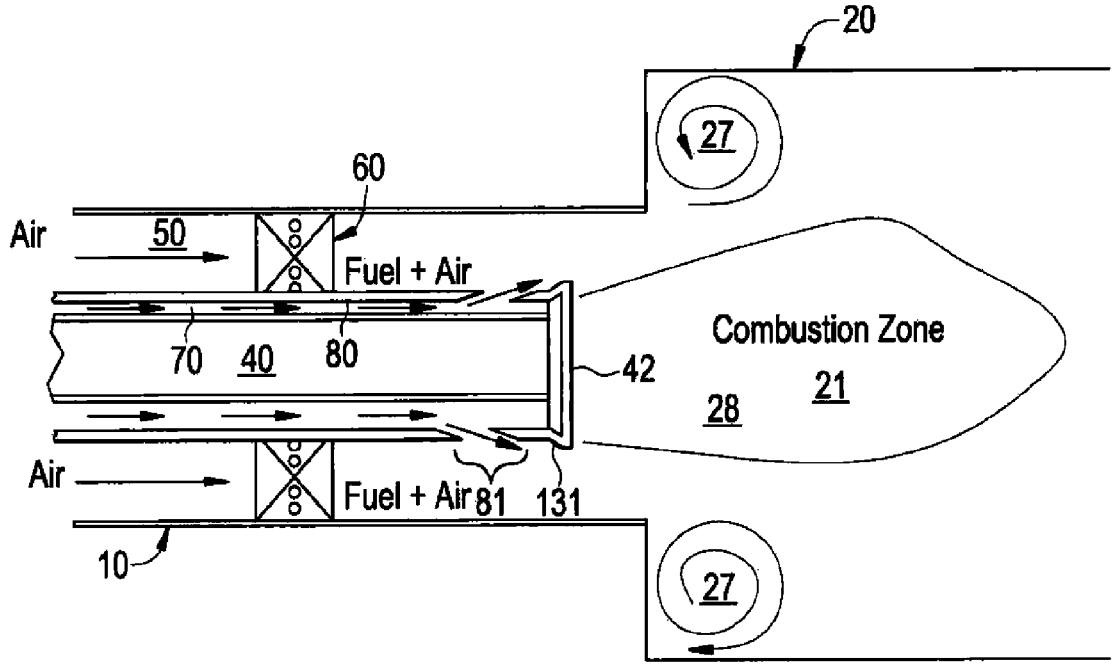
FIG. 4 is a side sectional view of a burner tube having an air injection passage and a contoured center body in accordance with another embodiment.

With reference to FIG. 4, in an embodiment, the passage 81 through the surface 80 and the contouring 131 of the surface 80 may be employed together. In this case, the combined effects of modifying the size of the primary recirculation zone 28 and significant drop in peak temperature result in a significant NOx emissions reduction.

Figure 5:
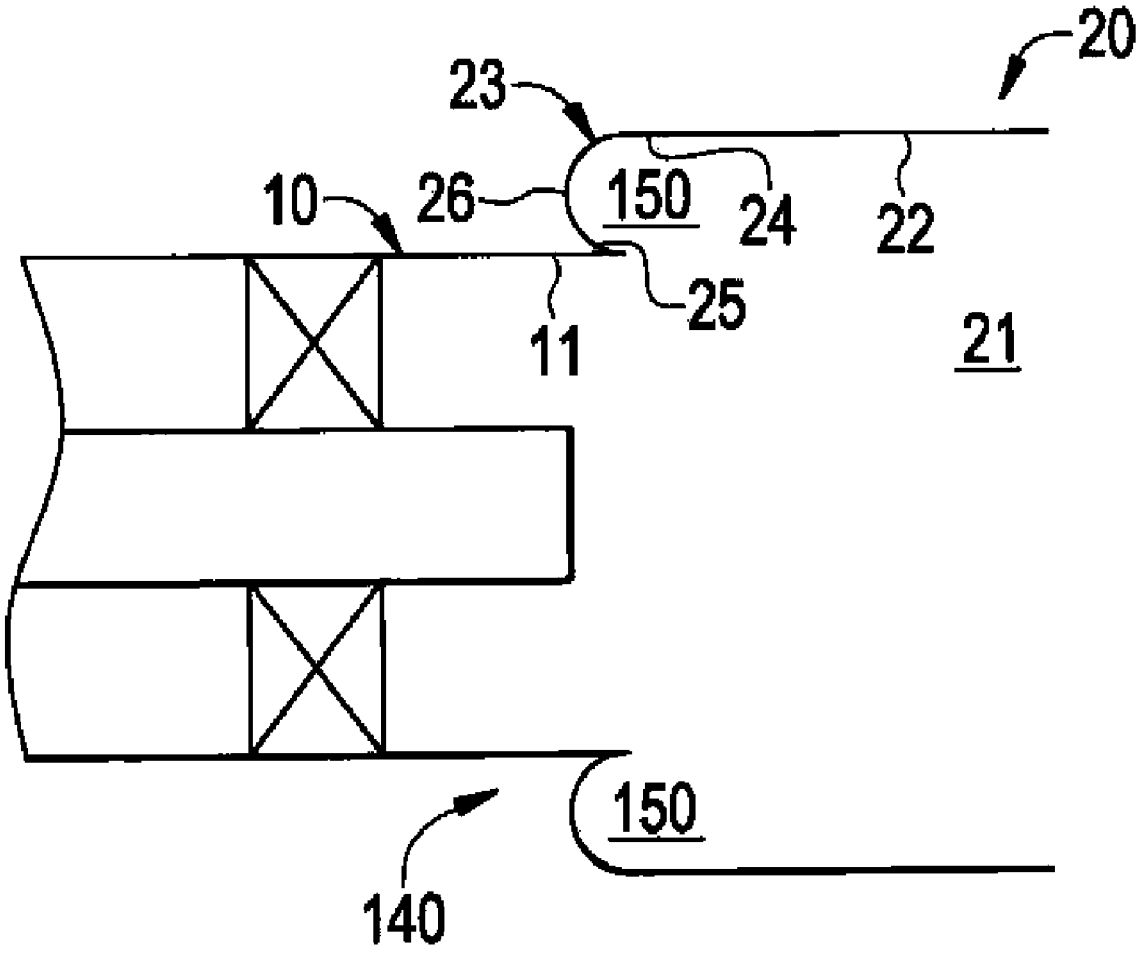
FIG. 5 is a side sectional view of a burner tube and a combustor in accordance with another embodiment.

With reference to FIG. 5, an apparatus 140 is provided and includes a burner tube 10 from which combustible materials are output and a combustor 20, in an interior of which a combustion zone 21 is receptive of the combustible materials. The combustor 20 includes an annular liner wall 22 and an end plate 23. The end plate 23 has a first radial portion 24, which is coupled to a fore end of the liner wall 22, a second radial portion 25, to which an aft portion 11 of the burner tube 10 is coupled, and a curved section 26 interposed between the first and second radial portions 24 and 25. With this construction, an interior facing surface of the end plate 23 defines a bulging annular space 150 which is communicable with the combustion zone 21 of the combustor 20. The bulging annular space 150 can be designed to provide a selected size for the corner recirculation zone 27 so as to result in reduction of NOx formation.

Although not shown in FIG. 5, it is to be understood that the burner tube 10 of the apparatus 140 can include any or all of the features described above. Similarly, is to be further understood that the embodiments illustrated in FIGS. 1-4 can also include the features shown in FIG. 5. Likewise, while FIG. 1 shows one burner tube 10, the inventions described herein extend to embodiments wherein a multiplicity of burner tubes may be utilized to provide combustible material to the combustor 20.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A burner tube to provide combustible materials to a combustor, comprising:

an annular shroud; and a center body, having a cavity defined therein, disposed within the annular shroud to form an annular passage, the annular passage being communicable with a combustion zone of the combustor at an aft portion thereof and including a fore portion in which fuel is injected into the annular passage, the center body including:

a surface disposed around the center body to form an outer exterior thereof with the cavity defined between the center body and the surface, the surface having a passage defined therein through which air is to be supplied to the annular passage from the cavity at a position, which is downstream from the fuel injection and upstream from the combustion zone.

2. The burner tube according to claim 1, wherein the annular shroud has a second passage defined therein through which air is to be supplied in a radially inward direction to the annular passage.

3. The burner tube according to claim 1, wherein the passage is plural and arrayed substantially linearly around the center body.

4. The burner tube according to claim 1, wherein the passage is plural and arrayed in a staggered formation around the center body.

5. The burner tube according to claim 1, wherein the passage comprises a concentric annular passage.

6. The burner tube according to claim 1, wherein the surface comprises an outward flare that protrudes radially outwardly into the annular passage beyond a radially outermost dimension of the center body.

7. The burner tube according to claim 1, wherein the surface comprises a hump that protrudes radially outwardly into the annular passage beyond a radially outermost dimension of the center body.

8. The burner tube according to claim 1, wherein a quantity of the air to be supplied to the annular passage is automatically controlled.

9. A burner tube to provide combustible materials to a combustor, comprising:

an annular shroud; and a center body disposed within the annular shroud to form an annular passage, the annular passage being communicable with a combustion zone of the combustor at an aft portion thereof and having a fore portion in which fuel is injected into the annular passage, the center body including:

a surface that protrudes radially outwardly into the annular passage beyond a radially outermost dimension of the center body at a position, which is downstream from the fuel injection and upstream from the combustion zone, wherein the center body has a cavity defined therein, the surface being disposed around the center body to form an outer exterior thereof with the cavity defined between the center body and the surface, the surface having a passage defined therein through which air is to be supplied to the annular passage from the cavity, and wherein a quantity of the air to be supplied to the annular passage is automatically controlled in response to current conditions.

10. The burner tube according to claim 9, wherein the surface comprises an outward flare.

11. The burner tube according to claim 9, wherein the surface comprises a hump.

* * * * *